United States Patent [19]

Bänninger et al.

[11] Patent Number: 4,756,357

[45] Date of Patent: Jul. 12, 1988

[54] PROCESS AND DEVICE FOR CONTROLLING THE RATE OF COOLING A CONTINUOUSLY CAST INGOT

[75] Inventors: Urs Bänninger, Wollerau; Kurt Buxmann, Sierre; Miroslaw Plata, Sion, all of Switzerland

[73] Assignee: Swiss Aluminium Ltd., Chippis, Switzerland

[21] Appl. No.: 936,808

[22] Filed: Dec. 2, 1986

[30] Foreign Application Priority Data

Dec. 9, 1985 [CH] Switzerland ..... 5258/85

[51] Int. Cl.[4] ..... B22D 11/22; B22D 27/02

[52] U.S. Cl. ..... 164/455; 164/414; 164/467; 164/503

[58] Field of Search ..... 164/483, 150, 414, 455, 164/467, 503, 443, 444, 485, 486, 487

[56] References Cited

U.S. PATENT DOCUMENTS

| | | | |
|---|---|---|---|
| 3,886,991 | 6/1975 | Meier et al. | 164/414 X |
| 4,166,495 | 9/1979 | Yu | 164/122 X |
| 4,530,404 | 7/1985 | Vives | 164/467 |

FOREIGN PATENT DOCUMENTS

| | | | |
|---|---|---|---|
| 59-199155 | 11/1984 | Japan | 164/155 |
| 935206 | 6/1982 | U.S.S.R. | 164/455 |
| 1109249 | 8/1984 | U.S.S.R. | 164/455 |

*Primary Examiner*—Kuang Y. Lin

*Attorney, Agent, or Firm*—Bachman & LaPointe

[57] ABSTRACT

A process for controlling the rate of cooling an ingot emerging from a continuous casting mold, said ingot being cooled by application of a fluid coolant directly onto the ingot surface, comprises continuous measurement of the cooling capacity and influencing the composition and/or the quantity of coolant employed per unit time i.e. in the sense of matching up to the required coolant capacity. As such the measurement of the coolant capacity is performed at least at one place outwith the ingot and using coolant not coming into contact with the ingot. The corresponding continuous casting unit features control elements (6) that act upon the composition and/or the amount of fluid coolant released per unit time and comprises at least one body (1) exhibiting good electrical conductivity; at least one coolant nozzle (2) which is connected to the coolant container (3) and is directed at a measuring point on the body (1); a heating device (4) that acts upon that point on the body (1); at least one temperature sensor (5,5') situated under the surface of the body (1) at the measuring point; and a data processing unit (7) connected up to the temperature sensor (5,5'), heating device (4) and control elements (6).

14 Claims, 2 Drawing Sheets

PROCESS AND DEVICE FOR CONTROLLING THE RATE OF COOLING A CONTINUOUSLY CAST INGOT

Figure 1:
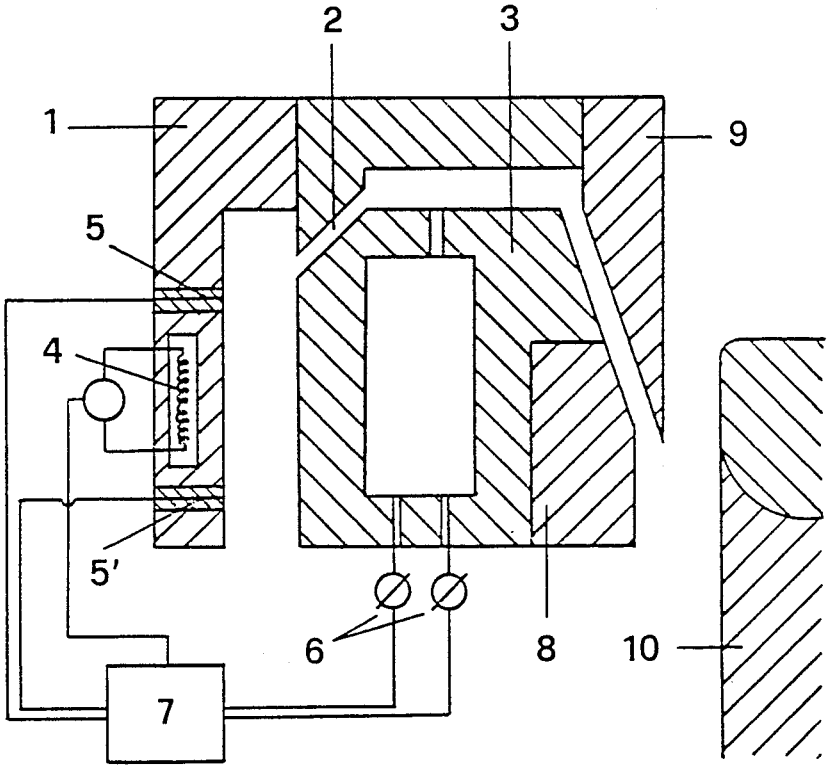

The invention relates to a process for controlling the rate of cooling an ingot emerging from a continuous casting mold, said ingot being cooled by application of a fluid coolant directly onto the ingot surface, and the control of cooling rate being achieved by regulating the cooling capacity of the coolant, this by continuously measuring the cooling capacity, comparing the measured values with the reference values for the required capacity and influencing the composition and/or the amount of coolant per unit time with a view to matching up with the reference values.

Also within the scope of the invention is a continuous casting unit having control elements that adjust the composition and/or amount of coolant released per unit time, and having a control facility for performing this.

During casting with direct cooling heat is extracted from the ingot emerging from the mold by jetting a fluid coolant onto the ingot surface immediately below the mold. The rate of heat extraction and the resultant rate of cooling influence to a high degree the structure of the cast ingot and in particular the shape of the ingot surface. Usually the coolant is released onto the surface at a constant amount per unit time.

In order to take into account the special characteristics of start up phase of casting, a series of devices and process have been developed which help to alter—usually reduce—the intensity of cooling during this place. In particular for the contactless, vertically downwards continuous casting of metals in an electromagnetic alternating field, the proposal is made in the European patent No. EP-B-0 015 870 for fine regulation of the angle and range of coolant impact by controlled deflection of the coolant in order to be able to adjust solidification conditions optimally to suit the alloys and casting speeds. Proposed in the European patent No. EP-B-062 606, as a means of avoiding convex doming of the ingot base due to non-steady state cooling conditions during the start-up phase, is a moveable deflection surface running parallel to the axis of the ingot and featuring recesses, said deflection surface being introduced into the path of the coolant at least during the start-up phase. The European patent No. EP-B-0 082 810 describes a further method for reducing the curvature of the ingot base due to too rapid cooling of the ingot. In that case, at least during the start-up phase, a substance that releases a gas as a decomposition product when contact is made with the hot surface of the ingot is added to the coolant; this gas then forms an insulating film which reduces heat extraction. Further, known from patent No. EP-A-0 127 577 is a process for continuous casting in which the ingot is cooled with water containing carbon dioxide. The amount of carbon dioxide added is kept constant during the start-up phase. Its concentration in the coolant, however, is reduced by increasing the flow rate of the water and, at the same time, the thermal contact between the surface of the ingot and the coolant is increased. The addition of carbon dioxide should be terminated after the start-up phase or after falling below a particular concentration of carbon dioxide.

In all of these processes, however, no account is taken of the fact that fluctuations can occur in the quality of the coolant, for example by fluctuations in the temperature or inpurities, and also differences in pressure which can markedly influence the cooling capacity.

A process for partly covering these problems is known from the German patent No. DE-A-19 41 816 viz., a process for regulating the rate of cooling long, moving hot objects of aluminum or aluminum alloys—in particular continuously cast ingots emerging from the mold—the regulation of the cooling rate being made as a function of the surface temperature of the moving object. In the example of cooling by means of a fluid-air mixture the proposal made is to influence the quantity and pressure of the water and the composition of the mixture in accordance with the surface temperature. With aluminum-based materials in particular the use of a radiation type of pyrometer is problematic due to the different emission characteristics of aluminum and aluminum oxide with varying oxide skin thickness; for that reason a contact pyrometer or thermocouple is employed.

Such surface measurements are, however, labour intensive and subject to interruption and failure. The lack of space at continuous casting units also makes the installation of these devices more difficult. Especially when casting metals in an electromagnetic alternating field such devices, mounted close to the ingot surface, interfere with the casting procedures.

The object of the invention is therefore to develop a process of the kind mentioned at the start by means of which the contribution of the coolant cooling capacity, employed to regulate the cooling rate, can be controlled being interfered with or without interfering with the region close to the ingot periphery.

A further object is a continuous casting unit which is equipped to carry out this process.

With respect to the process this object is achieved by way of the invention by measuring the cooling capacity via coolant that does not come into contact with the ingot and this at least at one place outwith the ingot.

In the case of a closed circuit the coolant used for measurement within the same cycle must not have already come into contact with the ingot being cast.

After measurement of the ingot surface, the coolant can be jetted onto the ingot, directly disposed of or recycled.

In a preferred version of the process according to the invention a part of the coolant employed for cooling the ingot is directed away from the ingot at least at one measuring point. This measuring point must then have a higher temperature than that of the coolant striking it. The cooling capacity of the coolant is thus supervised by measuring the temperature at the thus jetted point of measurement. Deviations from a given value or sequence of values causes a correction to be made in the composition and/or pressure of the coolant. It is particularly favourable to select a measurement temperature as close as possible to the temperature of the ingot surface in the region where the coolant is jetted onto the ingot. The deviation in the absolute temperatures should in any case not exceed 20%. The risk of large differences in cooling behaviour due to temperature can thus be limited.

A useful version is such that the part of the coolant medium used for measurement is deflected or diverted onto body that is heated using local control heating. The heating can then act continuously or at definite intervals on the part of the body used for measurement purposes. The following two methods have been found to be particularly suitable as means for achieving the high standard for measuring coolant capacity: The temperature of the measurement point jetted with the coolant is kept constant, the heating necessary to achieve this is measured and compared with a given value and the coolant is influenced by the size of the deviation from that value. The second method is such that during a given interval of time the point of measurement is not heated or only by a smaller amount and the resultant drop in temperature employed as a measure of the cooling capacity. Between these intervals the region of the body used for measurement purposes is reheated to the original temperature.

A preferred version within the scope of the invention employs not only measurement points in the region of which the coolant makes direct contact but also points in a zone in which the coolant already jetted coolant flows along the surface of the body, essentially parallel to the same. Information from these different cooling zones make it possible to arrive at conclusions which can then be employed to make specific corrections to the various cooling capacity parameters.

The process according to the invention is probably to be employed to control the rate of cooling an ingot emerging from a continuous casting mold viz., such an ingot that is cooled by applying directly to the ingot surface coolants that release a gas in the process of cooling. The reduction in the cooling capacity that normally results from the release of the gas is registered by the measurements made in this process and is so in a manner very closely approaching reality.

The advantage of the special separation of the casting zone and the measurement zone in the process according to the invention is particularly useful in the case of contactless casting of metals in an electromagnetic alternating field. As in that case the ingot being cast is made to solidify practically exclusively by the fluid coolant medium, the regulation of the cooling capacity is of greatest significance.

The special features of the surface of aluminum and aluminum alloy ingots ensure that this control process, which is independent of the ingot surface, is pre-destined for such an application.

In a preferred version of the casting unit according to the invention the body bearing the measuring point is situated on the side of the coolant container facing away from the ingot being cast. The body can, however, also be positioned or built in to conventional components of the casting unit such that at least a part of the coolant strikes the measuring point on its way from the coolant container to the surface of the ingot.

With respect to the device the object according to the invention is achieved by providing the casting unit with control elements that act on the composition and/or amounts of coolant released per unit time, and feature a control facility comprising the following elements: at least one body exhibiting good thermal conductivity; at least one coolant nozzle which is connected to the coolant container and is directed at a measuring point on the body; a heating device that acts upon that point on the body; at least one temperature sensor situated under the surface of the body at the measuring point; and a data processing unit connected to the temperature sensor, the heating device and the control elements.

The heating device can for example be in the form of electrical resistance heating or as induction coils. It need not be possible in all versions to heat that part of the body employed for measuring purposes while it is in the measuring position; also lying within the scope of the invention are devices in which the measuring point can be moved for heating purposes to a heating position which is different from the measuring position.

A particularly useful version of the continuous casting unit features in the body used for measurement purposes two built-in temperature sensors that are arranged at a distance of 20–200 mm apart in such a manner that a coolant nozzle is directed at one of these sensors and the other lies in the direction in which the coolant flows away from the first point. The surface of the body is thus preferably designed such that the stream of jetted and flowing coolant is approximately the same as the stream of coolant acting on the ingot.

If the casting unit according to the invention is intended for casting ingots of rectangular cross-section, for example strips, then it is advantageous to arrange bodies with measurement points both at the corners and in the region of the long sides of the rectangular cross-section such as in the region of the middle of the long sides. Deviations in cooling capacity, due to local differences in coolant fluid pressure, can in particular be registered this way and taken into account by optimising the condition of the coolant.

Figure 2:
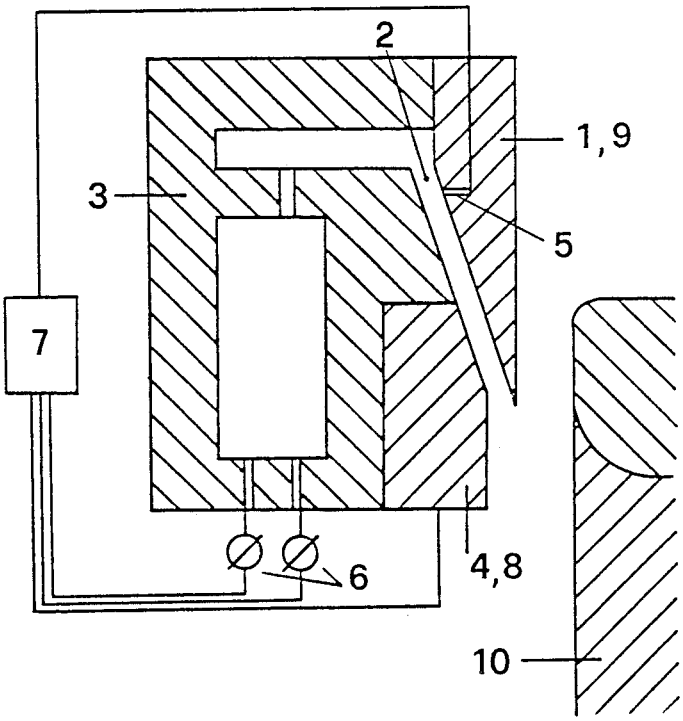

Further advantages, features and details of the invention are revealed in the following description of preferred exemplified embodiments and with the aid of the drawings viz.;

FIGS. 1 and 2 In each case a schematic cross-section through a part of a continuous casting unit according to the invention and part of an ingot being cast.

The electromagnetic continuous casting units represented in FIGS. 1 and 2 feature an inductor 8, a coolant container 3 with coolant nozzles 3 and screen 9. The unit shown in FIG. 1 features a body 1, which is mounted on the side of the coolant container facing away from the ingot 10. The coolant emerges from the container 3 and flows through an opening between the inductor 8 and the screen 9 on the surface of the ingot 10.

The ingot 10 is of an aluminum alloy AA 3004 and features a rectangular cross-section of 500 mm×1600 mm. Coolant is jetted onto the ingot at a rate of approx. 600 liters per minute.

During the start up phase the coolant container 3 contains a mixture of water and $NaHCO_3$ at a concentration of approx. 0.3%. At the end of the start up phase, after a 100 mm length of ingot has been cast, the addition of $NaHCO_3$ to the coolant container is discontinued.

Part of the coolant flowing out of the container 3 is diverted via nozzle 2 onto the first measuring point on the body 1. A temperature sensor 5 is situated behind the point of contact with the jetted coolant. This measures the surface temperature directly and is the type of sensor described in European patent No. EP-A-0 162 809.

Situated a distance 70 mm vertically below the first temperature sensor 5 another such sensor 5' which lies in line with the coolant flowing away from the first sensor 5. The part of the body 1 measured by sensors 5 and 5' is heated in a controlled manner by a built-in heating device 4 in the form of electrical resistance heating. The amount of heat required to maintain a constant average temperature is measured and the corresponding information transmitted to a data processing unit 7. The average temperature is calculated from the temperatures measured by the sensors 5 and 5' which are transmitted to the data processing unit 7.

The ingot surface jetted with the coolant is at a temperature of about 420° C. in the region sprayed with the coolant. The first measuring point on the body 1 at sensor 5 is kept at a temperature of about 450° C. During the start-up phase $CO_2$ gas is released from the $NaHCO_3$ in the coolant, both on the surface of the ingot and on the surface of the body 1. The $CO_2$ released forms a film that considerably reduces the cooling capacity below that of pure water. The coolant container 3 is fitted on the supply side with control elements 6 one of which regulates the addition of $NaHCO_3$ while the other influences the water pressure. The control elements 6 are connected to the data processing unit 7 and are regulated by the same on the basis of comparison of the information from the heating device 4 and temperature sensors 5, 5' with given values.

The version shown in FIG. 2 employs the screen 9 as the body 1. The measuring points are situated on the inside of the screen 9 in such a manner that the coolant flowing from the coolant container 3 to the ingot 10 strikes them. Temperature sensors 5 are incorporated the measuring points, below the surface of the screen 9. The inductor 8 acts as a heating device 4 which maintains the screen at an equilibrium temperature, this at constant current and constant cooling capacity of the coolant. Also in this version the temperature sensors 5 are connected to a data processing unit 7 which in turn connects up with control elements 6 on the coolant container 3 and receives information about the current prevailing in the inductor 8.

What is claimed is:

1. Process for controlling the rate of cooling an ingot emerging from a continuous casting mold wherein said ingot is cooled by applying a fluid coolant directly onto a surface of the ingot and which comprises regulating the cooling capacity of the coolant to achieve control of the rate of cooling by continuously measuring the cooling capacity, comparing the measured cooling capacity with reference values for a required capacity, and influencing at least one of coolant composition and the amount of coolant per unit time with a view to matching up with said reference values, said cooling capacity measuring step comprising measuring the cooling capacity of the coolant which has not been in contact with said ingot at least at one place outwith the ingot.

2. Process according to claim 1, in which the measuring step comprises diverting a part of the coolant to at least one measuring point situated outwith the ingot and at a specified temperature, and monitoring the cooling capacity by means of temperature measurements.

3. Process according to claim 2, in which the absolute temperature of said at least one measurement point does not deviate by more than 20% from that of the ingot surface at the point of impact of the coolant.

4. Process according to claim 2, in which said diverting step comprises diverting the coolant onto a body which is heated by locally controlled heating.

5. Process according to claim 4, further comprising measuring the heating required to maintain said at least one measuring point at a constant temperature as a means of measuring the cooling capacity.

6. Process according to claim 4, further comprising measuring a drop in temperature per unit time at said at least one measuring point under conditions of reduced or discontinued heating as a means of measuring the cooling capacity.

7. Process according to claim 2, in which said temperature measurements are carried out at measuring points which are located on a surface of a body, said measuring points situated both in a region of impact by the coolant and in a downstream zone over which the coolant subsequently flows, the flow of coolant being essentially parallel to the surface of the body.

8. A process according to claim 1 wherein said direct application of the coolant to the ingot surface for cooling said ingot causes a gas to be released from the coolant.

9. A process according to claim 8 which is used in contactless continuous casting of metals in an electromagnetic alternating field.

10. A process according to claim 8 which is used in the continuous casting of aluminum or aluminum alloys.

11. Continuous casting unit having control elements (6) that act on at least one of fluid coolant composition and quantity of fluid coolant released per unit time and featuring a control facility for carrying out a process for controlling the rate of cooling an ingot emerging from a continuous casting mold comprising: at least one body (1) exhibiting good thermal conductivity; at least one coolant nozzle (2) connected to a coolant container (3) and directed at a measuring point on said at least one body; a heating device (4) that acts upon said point on said at least one body (1); at least one temperature sensor (5, 5') situated under a surface of the body (1) at the measuring point; and a data processing unit (7) connected to the temperature sensor (5, 5'), the heating device (4) and the control elements (6).

12. Continuous casting unit according to claim 11, in which the body (1) is mounted on the coolant container (3) on a side facing away from the ingot.

13. Continuous casting unit according to claim 11, in which the body (1) features a pair of temperature sensors (5, 5') spaced apart from each other by a distance of 20 to 200 mm and the coolant nozzle (2) being directed at the region of a first one of the sensors (5) while the other sensor (5') is situated downstream from the first sensor (5).

14. Continuous casting unit, according to claim 11 in which said ingots being cast each have a rectangular cross-section, and further comprising bodies (1) with measuring points in the region of corners and in a middle region of the long sides of the rectangular cross-section of the ingot.

* * * * *